US007116345B2

(12) United States Patent
Gyoutoku et al.

(10) Patent No.: US 7,116,345 B2
(45) Date of Patent: Oct. 3, 2006

(54) IMAGE FORMING APPARATUS HAVING A COOLER FOR AN ORGANIC ELECTROLUMINESCENCE ELEMENT

(75) Inventors: Akira Gyoutoku, Saga (JP); Takafumi Hamano, Fukuoka (JP); Yuuji Toyomura, Fukuoka (JP); Tetsuro Nakamura, Hyogo (JP); Yuzo Kawano, Fukuoka (JP); Kenichi Masumoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 179 days.

(21) Appl. No.: 10/726,594

(22) Filed: Dec. 4, 2003

(65) Prior Publication Data

US 2004/0145645 A1 Jul. 29, 2004

(30) Foreign Application Priority Data

Dec. 5, 2002 (JP) ..... P. 2002-354073
Nov. 25, 2003 (JP) ..... 2003-393620

(51) Int. Cl.
*B41J 2/45* (2006.01)

(52) U.S. Cl. ..... 347/238

(58) Field of Classification Search ..... 347/129–133, 347/135, 236–238, 246, 247, 253; 250/226; 310/89; 399/385
See application file for complete search history.

(56) References Cited

U.S. PATENT DOCUMENTS

| | | | | |
|---|---|---|---|---|
| 5,751,327 | A | 5/1998 | De Cock et al. | 347/130 |
| 5,768,675 | A * | 6/1998 | Estabrooks | 399/385 |
| 6,012,291 | A | 1/2000 | Ema | 62/3.7 |
| 6,121,993 | A * | 9/2000 | Maekawara et al. | 347/236 |
| 6,121,994 | A | 9/2000 | Kuribayashi et al. | 347/237 |
| 6,121,995 | A | 9/2000 | Kattner | 347/238 |
| 6,218,660 | B1 * | 4/2001 | Hada | 250/226 |
| 6,266,074 | B1 * | 7/2001 | Koumura et al. | 347/133 |
| 6,366,304 | B1 * | 4/2002 | Nakayasu et al. | 347/129 |
| 6,380,943 | B1 | 4/2002 | Morita et al. | 345/589 |
| 6,607,277 | B1 * | 8/2003 | Yokoyama et al. | 353/52 |
| 6,683,639 | B1 * | 1/2004 | Driessen-Olde Scheper et al. | 347/238 |
| 6,949,849 | B1 * | 9/2005 | Wright et al. | 310/89 |

FOREIGN PATENT DOCUMENTS

| | | |
|---|---|---|
| EP | 0550190 | 7/1993 |
| EP | 0731625 | 9/1996 |
| EP | 0916506 | 5/1999 |
| JP | 10-1664 | 1/1998 |
| JP | 2001-63136 | 3/2001 |
| JP | 2001-063136 | 3/2001 |
| WO | 02/15645 | 2/2002 |

OTHER PUBLICATIONS

An article by C.W. Tang et al., *Appl. Phys. Lett.* vol. 51, p. 913, 1987.
S. Lamansky et al., Journal of Applied Physics, vol. 92, No. 3, Aug. 1, 2002, pp. 1570-1575.

(Continued)

*Primary Examiner*—Hai Pham
(74) *Attorney, Agent, or Firm*—Greenblum & Bernstein, P.L.C.

(57) ABSTRACT

An image forming apparatus includes an exposer including an organic electroluminescence element including at least an anode for injecting a hole, a luminescent layer having a luminescent region and a cathode for injecting an electron on a board. A photosensitive member is formed with an electrostatic latent image by exposing light of the exposer, a developer forms a toner image on the photosensitive member by supplying a toner to the electrostatic latent image, and a cooler cools the organic electroluminescence element such that the temperature of the organic electroluminescence element can be controlled.

20 Claims, 7 Drawing Sheets

OTHER PUBLICATIONS

C. Adachi et al., Applied Physics Letters, vol. 78, No. 11, Mar. 12, 2001, pp. 1622-1624.

R.C. Kwong et al., Advanced Materials, vol. 12, No. 15, Aug. 2, 2000, pp. 1134-1138.

* cited by examiner

IMAGE FORMING APPARATUS HAVING A COOLER FOR AN ORGANIC ELECTROLUMINESCENCE ELEMENT

BACKGROUND OF THE INVENTION

The present invention relates to an image forming apparatus using exposing means in which an organic electroluminescence element is used as a light source.

An electroluminescence element is a luminescence device utilizing electroluminescence of a solid fluorescent substance. Currently, an inorganic electroluminescence element using an inorganic species material as a luminescence substance is reduced into practice and application and development thereof to a back light, a flat display or the like of a liquid crystal display is partially achieved.

However, according to an inorganic electroluminescence element, voltage necessary for being luminescent is as high as 100V or higher, blue color luminescence is difficult. Therefore, it is difficult to form full color display containing three original colors of RGB.

Further, according to an inorganic electroluminescence element, a refractive index of a material used as a luminescence substance is very large. Therefore, the material undergoes intensive influence of total reflection at an interface or the like, an efficiency of taking out light into air with regard to actual luminescence is as low as about 10 through 20% and high efficiency formation is difficult.

Meanwhile, researches on an electroluminescence element using an organic material have long attracted attention and various investigations have been carried out, however, since a luminescence efficiency is very poor, the researches have not progressed to a full scale research on reduction to practice.

However, in 1987, there has been proposed an organic electroluminescence element having a laminated layer structure of a function separating type dividing an organic material into two layers of a hole transporting layer and a luminescent layer by C. W. Tong et al. of Kodak Company. It has been found that a high luminescent brightness equal to or higher than 100 cd/m$^2$ has been achieved regardless of low voltage equal to or lower than 10V [refer to C. W. Tang and S. A. Vanslyke; Appl. Phys. Lett. 51(1987)913 etc.].

Thereafter, an organic electroluminescence element has started to suddenly attract attention, currently, researches on an organic electroluminescence element having a similar laminated layer structure of a function separating type are intensively carried out. Investigations are carried out sufficiently particularly on high efficiency formation/long service life formation which is indispensable for reducing an organic electroluminescence element into practice and in recent years, a display or the like using an organic electroluminescence element is realized.

Here, an image forming apparatus by an electrophotography technology is provided with exposing means for irradiating exposure light in accordance with image data to a photosensitive member charged uniformly at predetermined potential and writing an electrostatic latent image on the photosensitive member. Further, a primary exposure system of in the exposing means is constituted by a laser beam system or an LED array system.

When the exposure system is constituted by laser beam, a space occupied by an optical part of a polygon mirror, lens of the like is large and it is difficult to downsize the apparatus. Further, in the case of the LED array, since the board is expensive, the cost of the apparatus is difficult to reduce.

Further, when the above-described organic electroluminescence element is used for the light source, the problems can be resolved.

Further, there is an element structure of an organic electroluminescence element disclosed in JP-A-10-1664 or Japanese Patent Publication No. 2001-63136.

Here, an image forming apparatus includes a heat source at an inner portion thereof such as a fixer for fixing a toner image transcribed on a record medium.

Further, an organic electroluminescence element is liable to undergo influence of heat and as shown by FIG. 9, with rise in environmental temperature, a time period until brightness half-life is shortened. This signifies that with rise in environmental temperature, element life of an organic electroluminescence element is acceleratingly shortened.

Further, as shown by FIG. 10, relative brightness is significantly changed in accordance with the change in environmental temperature. This signifies that darkness of a developed image is changed by the change in the environmental temperature.

SUMMARY OF THE INVENTION

It is an object of the invention to provide an image forming apparatus using an exposing apparatus capable of adjusting temperature of an organic electroluminescence element.

In order to resolve the problem, an image forming apparatus of the invention is constructed by a constitution including exposing means including an exposure head comprising an organic electroluminescence element including at least an anode for injecting a hole, a luminescent layer having a luminescent region and a cathode for injecting an electron on a board, a photosensitive member formed with an electrostatic latent image by exposing light of the exposing means, developing means for forming a toner image on the photosensitive member by supplying a toner to the electrostatic latent image and cooling means for cooling the organic electroluminescence element.

The organic electroluminescence element is cooled by the cooling means in this way and therefore, the temperature of the organic electroluminescence element can be controlled.

As described above, according to the invention, the organic electroluminescence element is cooled by the cooling means and therefore, there is achieved an effective effect of capable of controlling the temperature of the organic electroluminescence element.

Thereby, there is achieved an effective effect of capable of preventing shortening of element life of the organic electroluminescence element by rise of environmental temperature and a change in a darkness of an image caused by a change in relative brightness of the organic electroluminescence element by a variation in the environmental temperature.

DETAILED DESCRIPTION OF THE PREFERRED EMBODIMENTS

Figure 1:
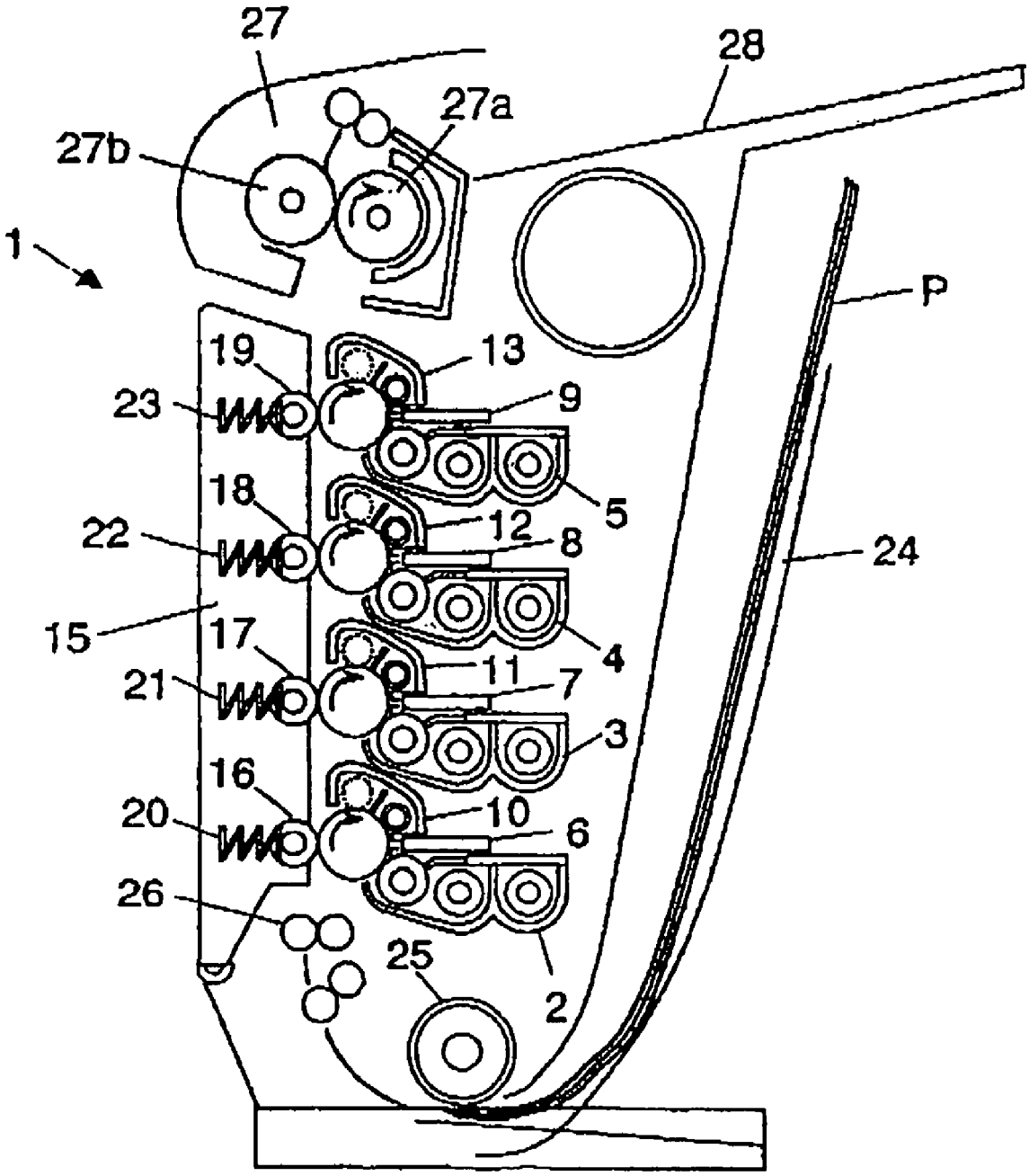
FIG. 1 is an outline view showing a constitution of a color image forming apparatus according to Embodiment 1 of the invention.

The invention provides an image forming apparatus which includes exposing means having an organic electroluminescence element including at least an anode for injecting a hole, a luminescent layer having a luminescent region and a cathode for injecting an electron on a board, a photosensitive member formed with an electrostatic latent image by exposing light of the exposing means, developing means for forming a toner image on the photosensitive member by supplying a toner to the electrostatic latent image and cooling means for cooling the organic electroluminescence element and the organic electroluminescence element is cooled by the cooling means and therefore, an effect of capable of restraining rise in the temperature of the organic electroluminescence element is achieved.

An explanation will be given of an embodiment of the invention in reference to FIG. 1 through FIG. 8 as follows. Further, in the drawings, the same members are attached with the same notations, further, a duplicated explanation will be omitted.

Figure 2A:
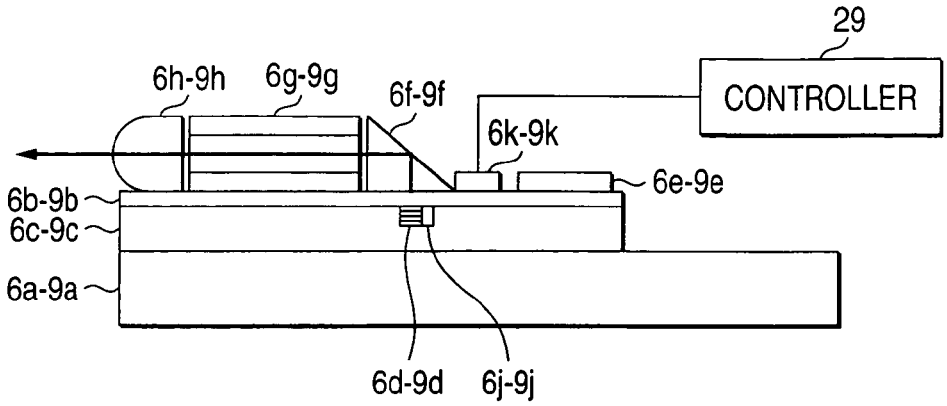
FIGS. 2A and 2B are explanatory views showing in details an exposing portion in the color image forming apparatus of FIG. 1.
Figure 2B:
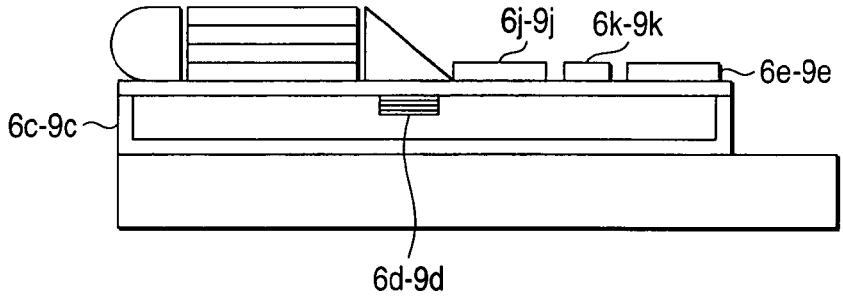
Figure 3:
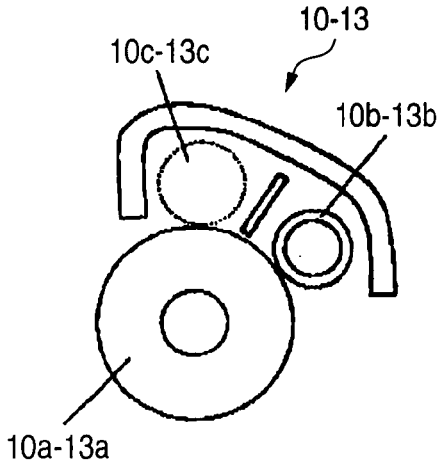
FIG. 3 is an explanatory view showing in details a photosensitive portion in the color image forming apparatus of FIG. 1.
Figure 7:
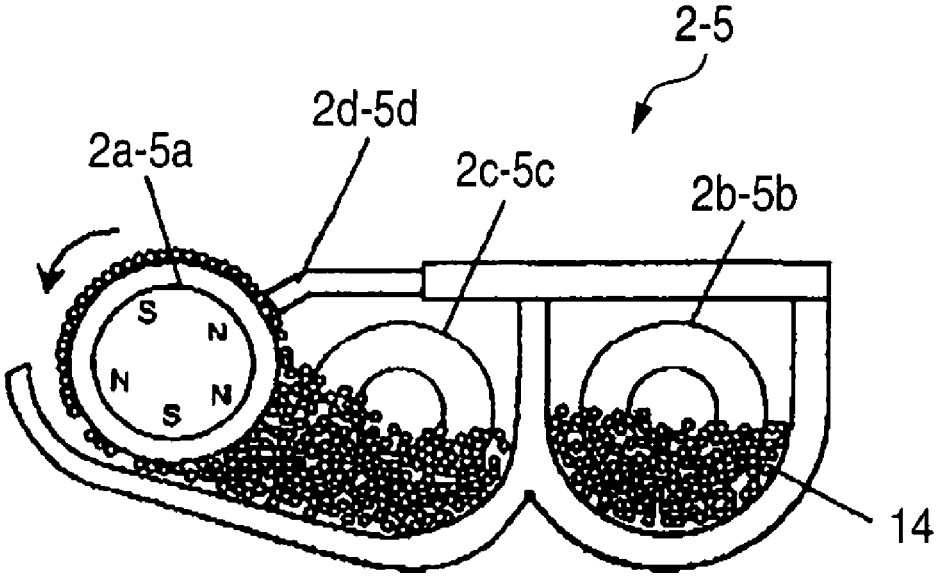
FIG. 7 is an explanatory view showing in details a developing portion of the color image forming apparatus of FIG. 1.
Figure 8:
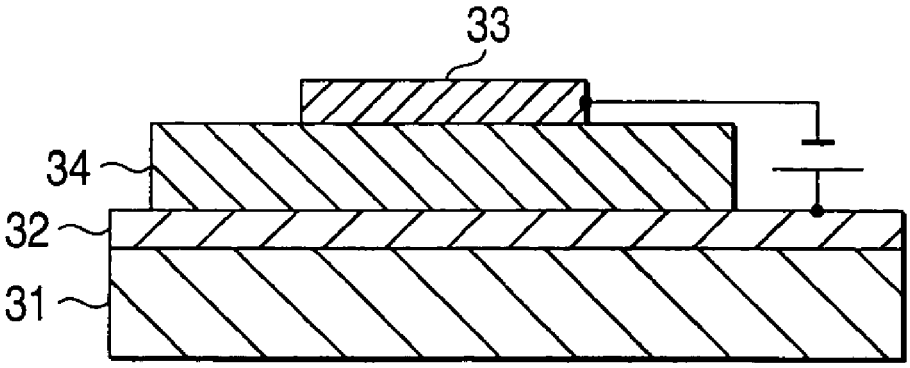
FIG. 8 is a sectional view showing an organic electroluminescence element used as a light source of the exposing portion of FIG. 2.

FIG. 1 is an outline view showing a constitution of a color image forming apparatus according to Embodiment 1 of the invention, FIGS. 2A and 2B are explanatory views showing in details an exposing portion of the color image forming apparatus of FIG. 1, FIG. 3 is an explanatory view showing in details a photosensitive portion in the color image forming apparatus of FIG. 1. FIG. 7 is an explanatory view showing in details a developing portion of the color image forming apparatus of FIG. 1 and FIG. 8 is a sectional view showing an organic electroluminescence element used as a light source of the exposing portion of FIG. 2.

In FIG. 1, a color image forming apparatus 1 is successively arranged with developing portion 2, 3, 4, 5 for respectively forming toner images of respective colors of yellow (Y), magenta (M), cyan (C) and black (K) and includes exposing portions (exposing means) 6, 7, 8, 9 and photosensitive portions 10, 11, 12, 13 in correspondence with respectives of the developing portions 2 through 5.

As shown by FIG. 2, the exposing portions 6 through 9 include head support members 6*a* through 9*a*, organic electroluminescence elements 6*d* through 9*d* as light sources constituting an exposure head mounted to base members 6*b* through 9*b* and sealed in air tight by sealing members 6*c* through 9*c* provided above the head support members 6*a* through 9*a*, and drivers 6*e* through 9*e* provided above the base members 6*b* through 9*b* for supplying voltages in correspondence with image data to the organic electroluminescence elements 6*d* through 9*d* to be luminescent.

Further, Peltier elements (cooling means) 6*j* are provided in contact with the organic electroluminescence elements 6*d* through 9*d*. The organic electroluminescence elements 6*d* through 9*d* are cooled by heat transfer by the Peltier effect of the Peltier elements 6*j* through 9*j*.

Further, there are provided temperature sensors 6*k* through 9*k* for detecting temperature of the exposure head having the organic electroluminescence elements 6*d* through 9*d*. When the temperature of the exposure head detected by the temperature sensors 6*k* through 9*k* exceeds a predetermined temperature, current is supplied to the Peltier elements 6*j* through 9*j* to start operation by controlling means 29 to thereby cool the organic electroluminescence elements 6*d* through 9*d*.

Further, prisms 6*f* through 9*f* for refracting irradiated light from the organic electroluminescence elements 6*d* through 9*d*, fiber arrays 6*g* through 9*g* for collecting light from the prisms 6*f* through 9*f* and cylindrical lenses 6*h* through 9*h* for focusing light from the fiber arrays 6*g* through 9*g* in a sub scanning direction are mounted above the base members 6*b* through 9*b*.

As shown in FIG. 3 in details, the photosensitive portions 10 through 13 include photosensitive drums (photosensitive members) 10*a* through 13*a* as image carriers provided rotatably, chargers (charging means) 10*b* through 13*b* brought into press contact with the photosensitive drums 10*a* through 13*a* for charging surfaces of the photosensitive drums 10*a* through 13*a* to uniform potentials and cleaners 10*c* through 13*c* for removing a toner remaining at the photosensitive drums 10*a* through 13*a* after transcribing images.

The photosensitive drums 10*a* through 13*a* rotated in peripheral directions are arranged in one column such that rotation center axes thereof are in parallel with each other. Further, the chargers 10*b* through 13*b* brought into press contact with the photosensitive drums 10*a* through 13*a* are rotated in accordance with rotation of the photosensitive drums 10*a* through 13*a*.

Further, as shown in FIG. 7 in details, the developing portions 2 through 5 include developing rollers (developing means) 2*a* through 5*a* for adhering toners to the photosensitive drums 10*a* through 13*a* formed with electrostatic latent images at peripheral faces thereof by irradiated light from the exposing portions 6 through 9 to form the electrostatic latent images as toner images, agitating members 2*b* through 5*b* for agitating a toner 14 in tanks, supply rollers 2*c* through 5*c* for supplying the toner 14 to the developing rollers 2*a* through 5*a* while agitating the toner 14 and doctor blades 2*d* through 5*d* for regulating the toner 14 supplied to the developing rollers 2*a* through 5*a* to predetermined thicknesses and charging the toner 14 by friction.

As shown by FIG. 1, a transcribing portion 15 for forming a color toner image by transcribing toner images of respective colors manifested on the photosensitive drums 10*a* through 13*a* on sheet (record medium) P to overlap each other is arranged at a position opposed to the exposing portions 6 through 9, the photosensitive portions 10 through 13 and the developing portions 2 through 5.

The transcribing portion 15 includes transcribing rollers 16 through 19 and springs 20 through 23 for respectively bringing the respective transcribing rollers 16 through 19 into press contact with the photosensitive drums 10*a* through 13*a*.

A sheet feeding portion 24 contained with sheet P is provided on a side opposed to the transcribing portion 15. Further, the sheet P is taken out from the sheet feeding portion 24 sheet by sheet by a sheet feeding roller 25.

A resist roller 26 for feeding the sheet P to the transcribing portion 15 at predetermined timings is provided on a sheet transporting path reaching the transcribing portion 15 from the sheet feeding portion 24. Further, a fixing portion 27 is arranged on a sheet transporting path on which the sheet P formed with the color toner image by the transcribing portion 15 travels.

The fixing portion 27 is provided with a heating roller 27*a* and a pressing roller 27*b* brought into press contact with the heating roller 27*a* and a color image transcribed on the paper P is fixed on the sheet P by pressure and heat accompanied by rotating the rollers 27*a* and 27*b* to pinch the sheet P.

In the image forming apparatus having such a constitution, first, a latent image having a yellow component color of image information is formed on the photosensitive drum 10*a*. The latent image is visualized on the photosensitive drum 10*a* as a yellow toner image by the developing roller 2*a* having a yellow toner. During the time period, the sheet P taken out from the sheet feeding portion 24 by the sheet feeding roller 25 is transmitted to the transcribing portion 15 by taking a timing by the resist roller 26. Further, the sheet P is pinched by the photosensitive drum 10 and the transcribing roller 16 to transport and at this occasion, the above-described yellow toner image is transcribed from the photosensitive drum 10*a*.

During a time period in which the yellow toner image is being transcribed on the sheet P, successively, a latent image having a magenta component color is formed and a magenta toner image by a magenta toner is visualized by the developing roller 3*a*. Further, the magenta toner image is transcribed on the sheet P transcribed with the yellow toner image to overlap the yellow toner image.

In the following, image formation and transcription are carried out similarly with regard to a cyan toner image and a black toner image and four colors of toner images finish to overlap on the sheet P.

Thereafter, the sheet P formed with the color image is transported to the fixing portion 27. At the fixing portion 27, the transcribed toner images are heated to fix on the sheet P and a full color image is formed on the sheet P.

The sheet P finished with a series of color image formation in this way is thereafter discharged onto a discharging tray 28.

In reference to FIG. 8, each of the organic electroluminescence elements 6*d* through 9*d* constituting light sources provided at the exposing portions 6 through 9, is formed with an anode 32 comprising a transparent conductive film formed by a sputtering method, a resistance heating evaporation deposit method or the like for injecting holes and a cathode 33 which is an electrode formed by the resistance heating evaporation deposit method or the like for injecting electrons on a board 31. Further, a luminescent layer 34 having a luminescent region is formed between the anode 32 and a cathode 33.

When direct current voltage or direct current is applied by constituting a plus electrode by the anode 32 of each of the organic electroluminescence elements 6*d* through 9*d* having the above-described constitution and constituting a minus electrode by the anode 33, the luminescent layer 34 is injected with holes from the anode 32 and injected with electrons from the cathode 33. At the luminescent layer 34, holes and electrons injected in this way are recombined and when excitons formed in accordance therewith are shifted from the excited state to the ground state, a luminescence phenomenon is brought about.

In the organic electroluminescence elements 6*d* through 9*d*, light irradiated from a fluorescent member (not illustrated) constituting the luminescent region in the luminescent layer 34 is emitted centering on the fluorescent member and irradiated via the board 31. Or, temporarily, light is reflected by the cathode 33 in a direction reverse to a direction of taking out light (direction of board 31) and is irradiated via the board 31.

Next, an explanation will be given of respective members constituting the organic electroluminescence elements 6*d* through 9*d*.

As the board 31 of each of the organic electroluminescence elements 6*d* through 9*d* according to the invention, a board which is transparent or semitransparent or opaque when the board is not used as a face for taking out light can be used and the board may be provided with strength capable of holding each of the organic electroluminescence elements 6*d* through 9*d*.

Further, according to the invention, in defining transparent or semitransparent, the definition indicates transparency to a degree of not hindering optical recognition of light emittance by the organic electroluminescence elements 6*d* through 9*d*.

As the board 31, there can be pertinently selected to use inorganic oxide glass of transparent or semitransparent soda-line glass, barium/strontium including glass, lead glass, aluminosilicate glass, borosilicate glass, barium borosilicate glass, quartz glass or the like, inorganic glass of inorganic fluoride glass or the like, or, a polymer film of transparent or semitransparent polyethylene terephthalate, a polycarbonate, polymethyl methacrylate, polyethersulfone, polyfluoride vinyl, polypropylene, polyethylene, polyacrylate, noncrystalline olefin, fluororesin or the like, or calcogenide glass of transparent or semitransparent $As_2S_3$, $As_{40}S_{10}$, $S_{40}Ge_{10}$ or the like, materials of metal oxides and metal nitrides of ZnO, $Nb_2O_5$, $Ta_2O_5$, SiO, $Si_3N_4$, $HfO_2$, $TiO_2$ or the like, or a semiconductor material of opaque silicon, germanium, silicon carbide, gallium arsenic, gallium nitride or the like, or the above-described transparent board material including pigment or the like, a metal material subjected to an insulating treatment at a surface thereof, and the like, and a laminated layer board laminated with a plurality of board materials can also be used.

Further, surface of the board or inside of the board may be formed with a circuit comprising resistors, capacitors, inductors, diodes, transistors and the like for driving the organic electroluminescence elements 6*d* through 9*d*.

Further, depending on use thereof, the board may be of a material for transmitting only a specific wavelength, a material having a light-light conversion function for converting to light having a specific wavelength or the like. Further, although it is preferable that the board is insulating, the board is not particularly limited thereto and may be conductive within a range of not hindering an organic electroluminescence display element from being driven or depending on use thereof.

As the anode 32 of each of the organic electroluminescence elements 6*d* through 9*d*, ITO (indium tin oxide), IZO (indium zinc oxide), ATO ($SnO_2$ doped with Sb), AZO (ZnO doped with Al) or the like is used therefor.

Here, although according to the embodiment, a thin film layer comprising an organic substance is constituted only by the luminescent layer 34, other than such a structure, there may be constituted a structure of any of two layer structure of a luminescent layer and a hole transporting layer, a two layer structure of a luminescent layer and an electron transporting layer and a three layer structure of a hole transporting layer a luminescent layer and an electron transporting layer.

As the luminescent layer, not only a fluorescent substance but also a phosphorescent substance may be used therefor, further, in order to promote efficiency by blocking holes, a hole blocking layer may be arranged at an interface between the luminescent layer and the electron transporting layer for increasing efficiency by blocking holes. The effect of the invention is not particularly governed by the element constitution of the organic electroluminescence.

The luminescent layer 34 of each of the organic electroluminescence elements 6*d* through 9*d* is preferably provided with a fluorescent or phosphorescent characteristic in a visible region and is provided with excellent film forming performance and there can be used, other than $Alq_3$ or Be-benzoquinolinol ($BeBq_2$), benzoxazolol species of 2,5-bis(5,7-di-t-pentyl-2-benzoxazolil)-1,3,4-thiaziazol, 4,4'bis (5,7-pentyl-2-benzoxazolil)stilbene, 4,4'-bis[5,7-di-(2-methyl-2-butyl)-2-benzoxazolil]stilbene, 2,5-bis(5,7-di-t-pentyl-2-benzosazolil)thiophene, 2,5-bis([5-α,α-dimethylbenzyl]-2-benzoxazolil)thiophene, 2,5-bis[5,7-di-(2-mehyl-2-butyl)-2-benzoxazolil]-3, 4-diphenyltiophene, 2,5-bis(5-methyl-2-benzoxazoil)thiophene, 4,4'-bis(2-benzoxazolil)biphenyl, 5-methyl-2-[2-[3-(5-methyl-2-benzosazolil)phenyl]vinyl]benzoxazolil, 2-[2-(4-chlorophenyl)vinyl]naphth[1,2-d]oxazolil or the like, benzothiazole species of 2,2'-(p-phenylenedivininylene)-bisbenzothiazole or the like, fluorescent white enhancing agent of benzimidazole species of 2-[2-[4-(2-benzimidazole)phynyl]vinyl]benzoimidazol, 2-[2-(4-caroxyphenyl)vinyl]benzoimidazole or the like, 8-hydroxyquinolin species metal complex of tris (8-quinolinol)aluminum, bis(8-quinolinol)magnesium, bis (benzo[f]-8-quinolinol)zinc, bis(2-methyl-8-quinolinolate) alminium oxide, tris(8-quinolinol)indium, tris(5-methyl-8-quinolinol)aluminium, 8-quinolinol lithium, tris(5-chloro-8-quinolinol)gallium, bis(5-chloro-8-quinolinol)calcium, poly [zinc-bis(8-nydroxy-5-quinolinolyl)methane] or the like or metal chelate oxynoid compound of dilithiumepindrizion or the like, styryl benzene species compound of 1,4-bis(2-methylstyryl benzene, 1,4(3-methylstyryl)benzene, 1,4-bis (4-methylstyryl)benzene, distyryl benzene, 1-4-bis(2-ethylstyryl)benzene, 1,4-bis(3-ethylstyryl)benzene, 1,4-bis(2-methylstyryl)2-methylbenzene or the like, diststilpyrazine derivative of 2,5-bis(4-methylstyryl)pyrazine, 2,5-bis(4-ethylstyryl)pyrazine, 2,5-bis[2-(1-naphthyl)vinyl]pyrazine, 2,5-bis(4-methoxystyryl)pyrazine, 2,5-bis[2-(4-biphenyl)vinyl]pyrazine, 2,5-bis[2-(1-pyrenyl)vinyl]pyrazine or the like, naphthalimide derivative, perylene derivative, oxadianol derivative, aldazine derivative, cyclopenthadiene derivative, stylylamine derivative, coumarin derivative, aromatic dimethylidine derivative or the like. Further, anthracene, salicylate, pyrene, chronene or the like is also used. Further, the first light emitting layer 34 and a second light emitting layer may be constituted by members the same as each other or may be constituted by different members.

Further, as the cathode 33 of each of the organic electroluminescence elements 6*d* through 9*d*, a metal or an alloy having a low work function is used therefor, a metal of Al, In, Mg, Ti or the like, an Mg alloy of Mg—Ag alloy, Mg—In alloy or the like, an Al alloy of Al—Li alloy, Al—Sr alloy, Al—Ba alloy or the like is used. Further, a laminated layer film of Li/Al, $Li_2O$/Al, LiF/Al or the like may be used.

Figure 4:
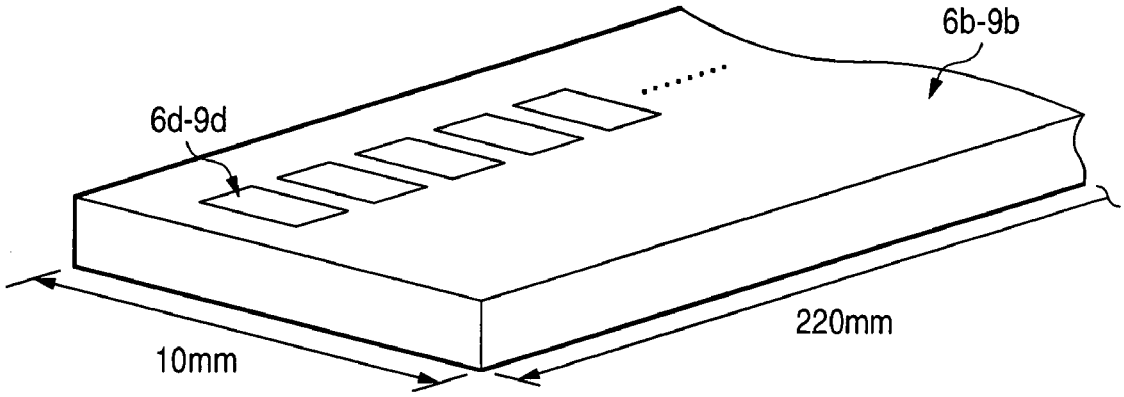
FIG. 4 is a perspective view showing a constitution of an organic EL head used in a color image forming apparatus of the invention.
Figure 5:
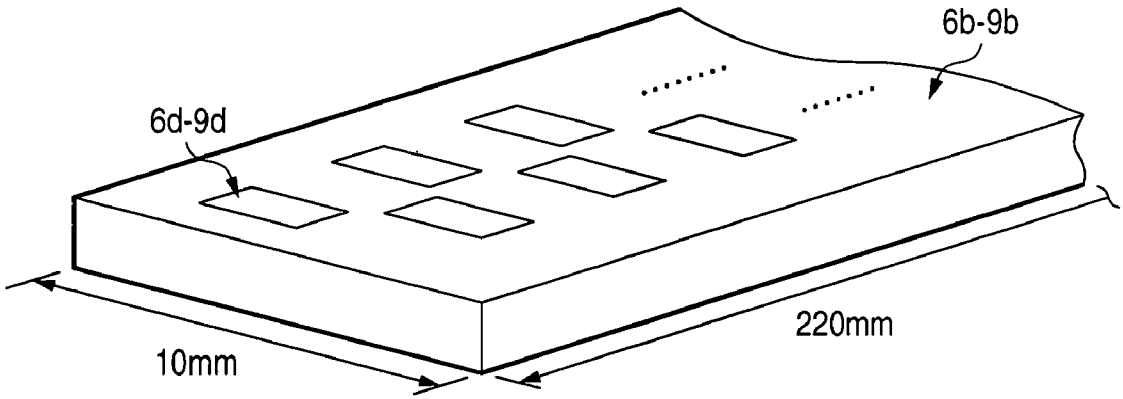
FIG. 5 is a perspective view showing a constitution of an organic EL head used in a color image forming apparatus of the invention.

FIG. 4 and FIG. 5 are perspective views showing a constitution of an organic E1 head used in the color image forming apparatus of the invention. As an example of a constitution of the organic EL head, for example, above the boards 6*b* through 9*b* having a length of 10 mm and a width of 220 mm, about 20,000 pieces of the electroluminescence elements 6*d* through 9*d* having a length of about 1 through 2 mm, a width of about 10 through 40 μm are aligned in a width direction in one column, when a resolution of 2400 dpi is provided and respectives are controlled to be luminescent by the controlling means 29 explained in reference to FIG. 2A.

Further, as other example, as shown by FIG. 5, the organic electroluminescence elements 6*d* through 9*d* may be aligned above the boards 6*b* through 9*b* in a zigzag shape.

The organic electroluminescence elements 6*d* through 9*d* explained in reference to FIG. 4 and FIG. 5 can respectively be provided with the Peltier elements 6*j* through 9*j* explained in reference to FIG. 2A proximately to the organic electroluminescence elements 6*d* through 9*d* or in contact with the organic electroluminescence elements 6*b* through 9*b* and the organic electroluminescence elements 6*d* through 9*d* are cooled by heat transfer by the Peltier effect of the Peltier elements 6*j* through 9*j*.

Further, the temperature sensors 6*k* through 9*k* for detecting the temperature of the exposure head having the organic electroluminescence elements 6*d* through 9*d* can be provided and when the temperature of the exposure head detected by the temperature sensors 6*k* through 9*k* becomes outside of predetermined temperature, current is supplied to the Peltier elements 6*j* through 9*j* by the controlling means 29 to start operation and the organic electroluminescence elements 6*d* through 9*d* are cooled.

Further, the organic electroluminescence elements 6*d* through 9*d* can be provided with the Peltier elements 6*j* through 9*j* and the temperature sensors 6*k* through 9*k* respectively in correspondence therewith and therefore, a temperature control suitable for each of the respective organic electroluminescence elements 6*d* through 9*d* can be carried out.

Figure 10:
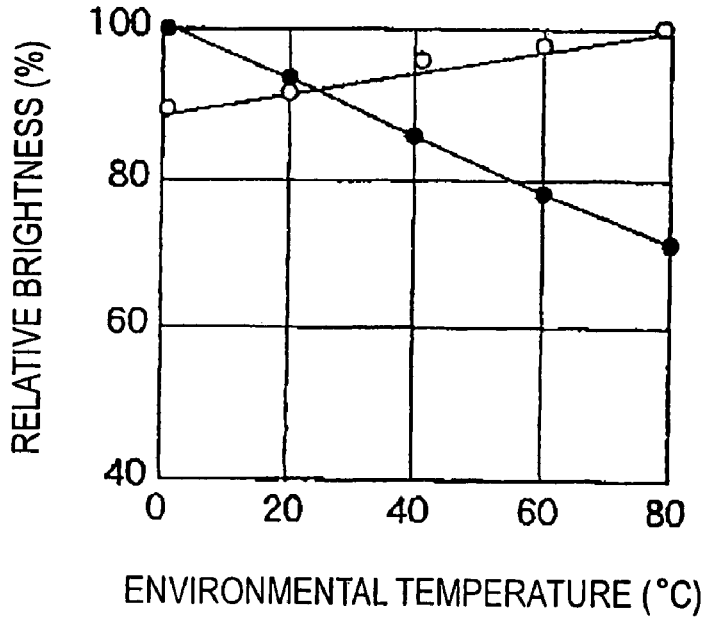
FIG. 10 is a graph showing a relationship between environmental temperature and relative brightness of an organic electroluminescence element.

Particularly, when the organic electroluminescence elements 6*d* through 9*d* are aligned in the width direction in one column as exemplified, temperature of the organic electroluminescence elements 6*d* through 9*d* at an end portion of the column may be lower than temperature of the organic electroluminescence elements 6*d* through 9*d* at a central portion of the column, or a dispersion of temperature may be brought about for the respective organic electroluminescence elements 6*d* through 9*d* and therefore, the controlling means 29 controls the temperature such that a dispersion in a light amount by the temperature difference of the organic electroluminescence elements 6*d* through 9*d* constituting the column is restrained in, for example, a range within ±3%. Naturally, in that case, as shown by FIG. 10, temperature dependency of the light amount differs by the material and the function of the element. That is, the temperature control may not be carried out generally in a constant range but the temperature needs to be controlled in a temperature range matching the element function.

Although the Peltier elements 6*j* through 9*j* are provided in contact with one-side faces of the organic electroluminescence elements 6*d* through 9*d* in FIG. 2A, for example, when all or a plurality of faces of other side faces excluding luminescent faces are covered by the Peltier elements 6*j* through 9*j*, a further effective cooling control can be carried out.

Moreover, as shown in FIG. 2B, the Peltier elements may be disposed closed to the prism 6*f* to 9*f* on a surface of the base member 6*b* to 9*b*. In case of that the Peltier elements are disposed on the surface of the base member 6*b* to 9*b*, heats generated by the luminescent elements 6*d* to 9*d* becomes easy to diffuse in comparison with the configuration shown in FIG. 2A in that the Peltier elements are enclosed in the sealing members.

As means for cooling the head, other than the Peltier element, there are conceivable a method of laying a cooling sheet at a vicinity of each of the organic electroluminescence elements 6*d* through 9*d*, means for providing a cooling fan, method of arranging a cooling tube along a vicinity of each of the organic electroluminescence elements 6*d* through 9*d* and making a liquid of water, ethylene glycol or the like flow in the cooling tube to cool.

As a heat radiating heat, a thermally conductive sheet comprising a material of, for example, carbon graphite or silicone rubber, a heat radiating sheet constituted by pasting thin copper or the like on a liquid crystal polymer film or the like is used. The carbon graphite sheet is a sheet formed by baking a polyimide film at high temperatures, anisotropy can be provided to the thermal conductivity and heat can efficiently be transferred in a specific direction. Further, the carbon graphite sheet is provided with flexibility and excellent in workability and therefore, the sheet can easily be arranged when the heat radiating path is complicated or even when a heat radiating object is constituted linearly. The heat radiating sheet is requested to have thermal conductivity higher than that of the board or the sealing member of the organic electroluminescence elements and the material per se is not particularly limited.

Figure 6A:
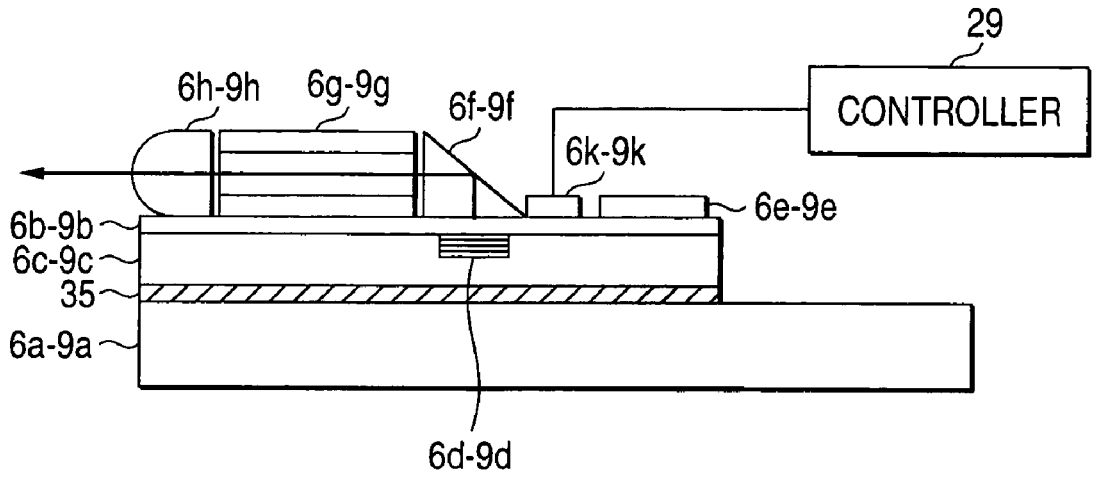
FIGS. 6A and 6B are sectional views showing a constitution of an organic EL head used in a color image forming apparatus of the invention.

FIG. 6A is a sectional view showing a constitution of an organic EL head used in the color image forming apparatus of the invention and as means for cooling the head, a carbon graphite sheet 35 is laid at a vicinity of the organic electroluminescence elements 6*d* through 9*d*. By constituting in this way, heat of the organic electroluminescence elements 6*d* through 9*d* is absorbed by the carbon graphite sheet 35 to radiate to a periphery to properly maintain temperatures of the organic electroluminescence elements 6*d* through 9*d*.

Although the carbon graphite sheet 35 may be laid below the sealing members 6*c* through 9*c* as shown by FIG. 6A, there are conceivable other various constitutions in which the sealing members 6*c* through 9*c* are laid between the boards 6*b* through 9*b* and the sealing members 6*c* through 9*c*, below the head supporting members 6*a* through 9*a*, upper faces of the boards 6*b* through 9*b* and the like.

Figure 6B:
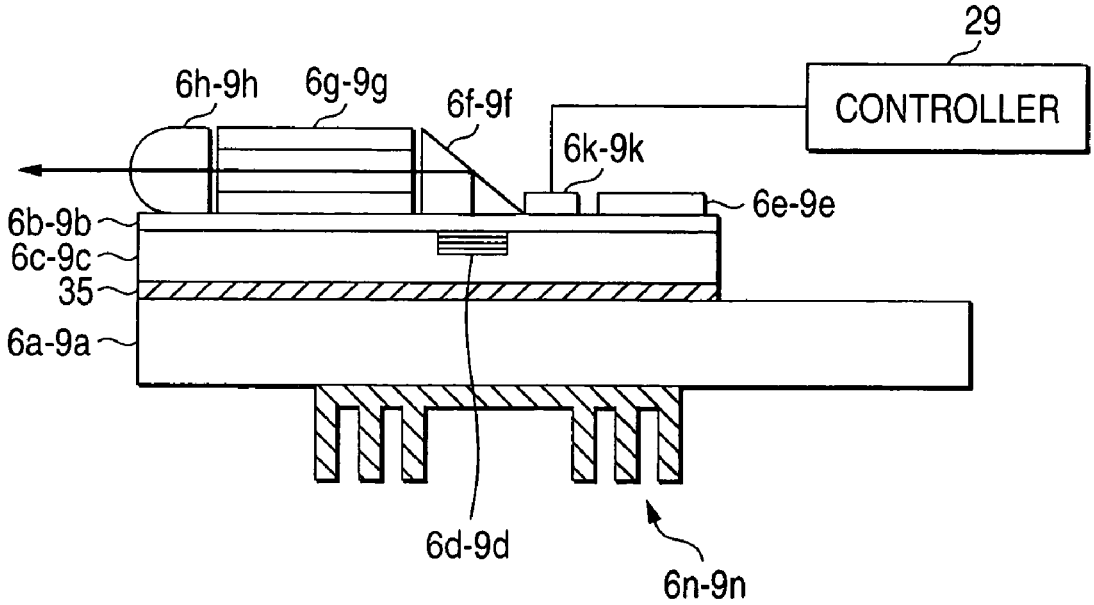

Further, as shown in FIG. 6B, fins 6*n* through 9*n* may be provided under the head supporting member so that the heats from the organic electroluminescence elements 6*d* through 9*d* are efficiently radiated.

Figure 13:
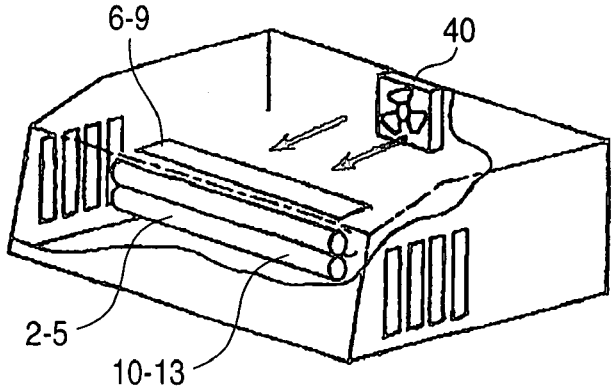
FIG. 13 is a views showing a fan provided in the image forming apparatus of the present invention.

As other method, a fan 40 can be provided on a cabinet side wall of the color image forming apparatus such that outside air can be taken into the apparatus as shown in FIG. 13. In this case, by providing the fan in a direction of blowing wind in a direction (arrow mark direction) orthogonal to a longitudinal direction of the boards 6*b* through 9*b* in FIG. 5, temperature rise of a total of the respective pieces of the organic electroluminescence elements 6*d* through 9*d* can be restrained and further, temperature differences of respective pixels in respective single pieces of the organic electroluminescence elements 6*d* through 9*d* can be maintained substantially constant.

Figure 9:
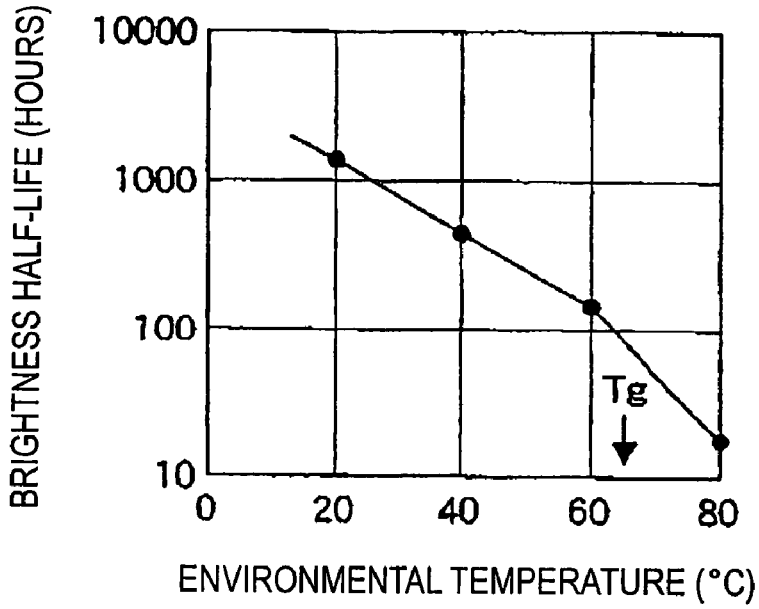
FIG. 9 is a graph showing a relationship between environmental temperature and brightness half-life in an organic electroluminescence element.

FIG. 9 is a graph showing a relationship between environmental temperature and brightness half-life in the organic electroluminescence element and FIG. 10 is a graph showing a relationship between environmental temperature and relative brightness in the organic electroluminescence element.

In the image forming apparatus having the above-described constitution, when environmental temperature is elevated by a heat source of the heating roller 27*b* or the like of the fixing portion 27 to thereby elevate temperatures of the organic electroluminescence elements 6*d* through 9*d*, element life is shortened (refer to FIG. 9) and brightness of the element, that is, darkness of developed image is changed (refer to FIG. 10).

As shown by FIG. 10, there are an element brightness of which is reduced with rise of temperature (element plotted by ⊘mark in the drawing) and an element brightness of which is increased with rise of temperature (element plotted by ○ mark in the drawing) on the contrary.

A change in the brightness by temperature of the organic electroluminescence element is caused by a difference of an efficiency of injecting holes and electrons by the characteristic of the material and therefore, there is a limit in an improvement by selecting the material or devising the constitution of the element. In order to achieve excellent image quality by constituting the image forming apparatus by the exposure head using the organic electroluminescence element, it is indispensable to control the environmental temperature per se, which is a very important technology.

Further, according to the organic electroluminescence element shown in FIG. 10, an element having a characteristic in correspondence with ○ mark is constituted by ITO/αNPD/$Alq_3$+$Ir(ppy)_3$/BCP/$Alq_3$/LiF/Al and an element having a characteristic in correspondence with ⊘mark is constituted by ITO/αNPD/$Alq_3$+$Ir(btp)_3$/BCP/$Alq_3$/LiF/Al.

Here, according to the image forming apparatus of the invention, the organic electroluminescence elements 6*d* through 9*d* are cooled by the Peltier elements 6*j* through 9*j*.

That is, the temperature of the exposure head is detected by the temperature sensors 6*k* through 9*k* and when the temperature of the exposure head is detected to be outside of predetermined temperature by the temperature sensors 6*k* through 9*k*, the Peltier elements 6*j* through 9*j* are operated by the controlling means 29 receiving the detection result to cool the organic electroluminescence elements 6*d* through 9*d*.

Further, temperature rise of the exposure head may be predicted from a relationship between the elapse time period and the rise of environmental temperature after making the power source of the image forming apparatus ON to flow current to the Peltier elements 6*j* through 9*j* based thereon.

That is, the relationship between the elapse time period and the rise of the environmental temperature after making the power source of the image forming apparatus ON is provided beforehand by an experiment or the and the result is provided to storing means as a table. By using the table, current in accordance with the elapse time period after making the power source of the image forming apparatus ON is made to flow to the Peltier elements 6*j* through 9*j*. Thereby, it is not necessary to provide the temperature sensors 6*k* through 9*k* and the controlling means 19 and constant brightness can always be achieved.

Here, the controlling means 29 cools the exposure head by adjusting current flowing in the Peltier elements 6*j* through 9*j* such that the environmental temperature in a steady state detected by the temperature sensors 6*k* through 9*k* becomes equal to or lower than crystallizing temperature Tg (for example, 65° C.) of an organic substance provided to the organic electroluminescence elements 6*d* through 9*d* (refer to FIG. 9).

As shown by FIG. 9, although when the environmental temperature is equal to or lower than the crystallizing temperature (Tg), the brightness half-life is comparatively linearly attenuated relative to a change in the temperature, when the temperature is exceeded, the brightness half-life is rapidly reduced. Further, it is difficult to predict an amount of the reduction.

Therefore, in a steady state of an environment for operating and maintaining the organic electroluminescence element, the environmental temperature needs to be equal to or lower than the crystallizing temperature (Tg) of the organic substance constituting the element. Further, the organic electroluminescence element shown in FIG. 9 is constituted by ITO/TPD/$Alq_3$/LiF/Al.

Further, since the darkness of the developed image is varied by the change in the temperatures of the organic electroluminescence elements 6*d* through 9*d* as described above, in order to restrain the image quality from being deteriorated by the variation in the darkness, it is preferable that a width of a variation in the temperature of the exposure head is set to ±20° C. of the environmental temperate in the steady state.

The reason will be explained as follows.

It is impossible to completely restrain a variation in a light amount of the exposure head used in the image forming apparatus. Hence, there is generally adopted a method of correcting the light amount by gray scale control. A number of bits allocated to gray scale correction is 4 bits for a low end kind and about 8 bits for a high end kind and in the case of 4 bits, a number of steps which can be ensured is 24=16 steps. Assuming that the light amount can be corrected by accuracy of about 1% at each step, the light amount of 16 steps, that is, 16% can be corrected by 4 bits.

Here, from the following equation, $$(1-A)\times(a+B)=1$$

where A: light amount change rate, B: light amount increase rate, A=B/(1+B)=0.16/1.16=0.14.

That is, when the change in the light amount is equal to or smaller than ±14%, the correction can be carried out by accuracy of ±1%. In reference to FIG. 10, when the light amount change is set to 14%, the temperature change needs to be about ±20° C.

In this case, it is preferable to control current supplied to the organic electroluminescence elements 6*d* through 9*d* such that luminescent amounts of the organic electroluminescence elements 6*d* through 9*d* become constant based on temperature information from the temperature sensors 6*k* through 9*k*. Thereby, there is not the variation in the developed darkness caused by the luminescent amounts of the organic electroluminescence elements 6*d* through 9*d* by the variation in the environmental temperature and the image quality can be prevented from being deteriorated by the variation in the darkness.

In this way, according to the embodiment, since the organic electroluminescence elements 6*d* through 9*d* are cooled by the Peltier elements 6*j* through 9*j*, the temperatures of the organic electroluminescence elements 6*d* through 9*d* can be controlled.

Thereby, shortening of the element life of the organic electroluminescence elements 6*d* through 9*d* by rise in the environmental temperature can be prevented. Further, it is prevented that the relative brightnesses of the organic electroluminescence elements 6*d* through 9*d* are significantly changed by the variation in the environmental temperature to change the darkness of the developed image.

Although in the above-described explanation, an explanation has been given of a case of using the Peltier elements 6*j* through 9*j* as cooling means, the cooling means is not limited thereto but other various means of, for example, a fan, a fin (heat sink) and the like can be adopted.

Further, although in the above-described explanation, the organic electroluminescence elements 6*d* through 9*d* are cooled by operating cooling means of the Peltier elements 6*j* through 9*j* or the like based on the environmental temperature measured by the temperature sensors 6*k* through 9*k*, the light amount of light irradiated from the organic electroluminescence elements 6*d* through 9*d* may be detected by a light amount sensor and when the light amount of light detected by the light amount sensor becomes equal to or smaller than a predetermined amount, cooling means of the Peltier elements 6*j* through 9*j* or the like may be operated by the controlling means 29.

Or, a darkness of a toner image formed on the photosensitive drums 10*a* through 13*a* or on the sheet P may be detected by a darkness sensor and when the darkness of the toner image detected by the darkness sensor becomes equal to or smaller than predetermined darkness, cooling means of the Peltier elements 6*j* through 9*j* or the like may be operated by the controlling means 29.

Although in the above-described explanation, an explanation has been given of a case of applying the invention to the color image forming apparatus, the invention can also be applied to an image forming apparatus of a single color of, for example, black or the like. Further, when the invention is applied to the color image forming apparatus, developed colors are not limited to 4 colors of yellow, magenta, cyan and black.

Figure 11:
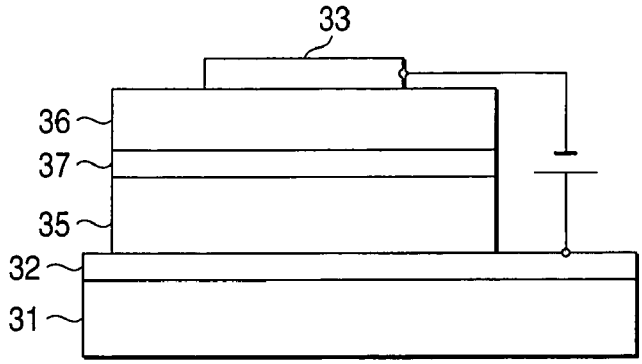
FIG. 11 is a view showing a section of an organic electroluminescence member used in an exposure head showing an embodiment of the invention.

FIG. 11 is a view showing a section of an organic electroluminescence member used in the exposure head according to an embodiment of the invention. The anode 32 which is an electrode comprising the transparent conductive film formed by a sputtering method, a resistance heating evaporation deposit method or the like for injecting holes and the cathode 33 which is an electrode formed by the resistance heating evaporation deposit method or the like for injecting electrons are formed the board 31.

Further, a luminescence unit 35 and a luminescence unit 36 are formed by interposing a buffer layer 37 between the anode 32 and the cathode 33. Electrons are injected from the buffer layer 37 to the luminescence unit 35 and holes are injected therefrom to the luminescence unit 36, further, holes are injected from the anode 32 to the luminescence unit 35, electrons are injected from the cathode 33 to the luminescence unit 36 and electrons and holes are combined by the individual luminescence units per se and luminescence is brought about at the respective units.

By constructing the luminescence unit 35 by a constitution having a characteristic in correspondence with ○ mark in which the brightness is increased with an increase in the temperature shown by FIG. 10 and constructing the luminescence unit 36 by a constitution having a characteristic in correspondence with ⊙mark in which the temperature is reduced by an increase in the temperature, temperature characteristics of the individual luminescence units are cancelled by each other and temperature dependency of a total of the organic electroluminescence member is reduced.

Further, a similar effect is achieved even by constructing the luminescent element in contact with the anode by a constitution having a characteristic in correspondence with ⊛mark in which the brightness is reduced with an increase in the temperature and constructing the luminescence unit in contact with the cathode by a constitution having a characteristic in correspondence with ○ mark in which the brightness is increased with an increase in the temperature regardless of the constitutions and the orders of the luminescence units particularly.

The material of the buffer layer is not particularly limited but the material may be anything so far as the material can supply electric charge to the light emitting unit and various members of a conductor, for example, ITO, IZO, $SnO_2$, $V_2O_5$, a semiconductor, MoOx, SiOx, dielectric substance, BiOx, MgOx, an insulating substance, TiOx, CaOx, AlN and the like or a laminated layer film laminated with a plurality of materials can be used.

Figure 12:
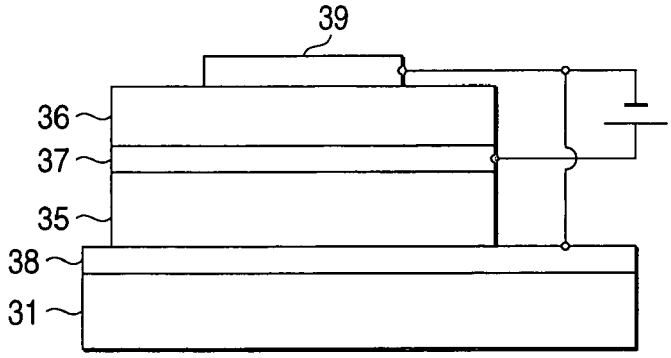
FIG. 12 is a view showing a section of an organic electroluminescence member used in an exposure head showing an embodiment of the invention.

When a conductor is used in the buffer layer, a method of applying voltage different from that of the constitution shown by FIG. 11 can be carried out and FIG. 12 is a view showing a section of an organic electroluminescence member used in an exposure head showing an embodiment of the invention.

In this case, holes are injected from the buffer layer 37 to the luminescence element 35 and electrons are injected from an electrode 38 thereto. Holes are injected from the buffer layer 37 to the luminescence unit 36 and electrons are injected from an electrode 39 thereto to make the respective luminescence units luminescent.

Also when the respective luminescence units are made to be luminescent by applying voltage by a method shown by FIG. 12, when the respective luminescence units are selected in consideration of temperature characteristic thereof, temperature dependency of the total of the organic electroluminescence member can be improved regardless of a method of applying the voltage.

Although according to the embodiment, only two layers of the luminescence units are shown, a number of laminated layers is not particularly limited but the embodiment can be carried out even by three layers, four layers or more of the luminescence elements and by two layers, three layers or more of the buffer layers in accordance therewith.

Further, although according to the embodiment, there is shown only a case of using a low molecular phosphorescent material for the luminescent element, the embodiment may be an organic electroluminescence member constituted by using a low molecular fluorescent material, further, it has been confirmed that a similar effect is achieved even by a constitution in which a portion or a total of the luminescent element comprises a high molecular material.

According to the invention, the organic electroluminescence element is cooled by cooling means and therefore, there is achieved an effect of capable of controlling temperature of the organic electroluminescence element, which is preferable in the field of the image forming apparatus using exposing means constituting the light source by the organic electroluminescence element.

The present application claims priority of Japanese Application Nos. 2002-354073, filed on Dec. 5, 2002, and 2003-393620, filed on Nov. 25, 2003, the contents of both being herein incorporated by reference in their entireties.

What is claimed is:

1. An image forming apparatus, comprising:

an exposer including an organic electroluminescence element having an anode that injects a hole, a luminescent layer having a luminescent region, and a cathode that injects an electron on a board;

a cooler that cools the organic electroluminescence element;

a temperature sensor that detects a temperature of the exposer; and a controller that operates the cooler when a temperature of the exposer detected by the temperature sensor exceeds a predetermined temperature;

wherein the controller controls the cooler to cool the exposing device to an environmental temperature in a steady state equal to or lower than a crystallizing temperature of an organic substance of the organic electroluminescence element.

2. An image forming apparatus, comprising:

an exposer including an organic electroluminescence element having an anode that injects a hole, a luminescent layer having a luminescent region and a cathode that injects an electron on a board;

a cooler including at least one of a Peltier element, a fan and a fin that cools the organic electroluminescence element;

a temperature sensor that detects a temperature of the exposer; and a controller that operates the cooler when the temperature of the exposer detected by the temperature sensor exceeds a predetermined temperature, wherein the controller controls the cooler to cool the exposer to an environmental temperature in a steady state equal to or lower than a crystallizing temperature of an organic substance of the organic electroluminescence element.

3. An image forming apparatus, comprising:

a photosensitive member;

a charger configured to charge the photosensitive member;

an exposer configured to irradiate the photosensitive member with light to form an electrostatic latent image, the exposer comprising an organic electroluminescence element;

a developer configured to adhere toner to the photosensitive member to form a toner image of the electrostatic latent image;

a transferor configured to transfer the toner image formed on the photosensitive member onto a recording medium;

a fixer configured to fix the toner image transferred onto the recording medium; and a cooler configured to cool the organic electroluminescence element to a predetermined temperature equal to or lower than a crystallizing temperature of an organic substance of the organic electroluminescence element.

4. The image forming apparatus according to claim 3, wherein the cooler comprises a Peltier element.

5. The image forming apparatus according to claim 3, wherein the cooler comprises a fin configured to radiate heat from the organic electroluminescence element.

6. The image forming apparatus according to claim 3, wherein the cooler comprises a fan that blows air toward the exposer.

7. The image forming apparatus according to claim 6, further comprising a cabinet, wherein the fan is provided on the cabinet.

8. The image forming apparatus according to claim 3, wherein the cooler comprises a thermally conductive sheet provided in a vicinity of the organic electroluminescence element.

9. An image forming apparatus, comprising:

a photosensitive member;

a charger configured to charge the photosensitive member;

an exposer configured to irradiate the photosensitive member with light to form an electrostatic latent image, the exposer comprising an organic electroluminescence element;

a developer configured to adhere toner to the photosensitive member to form a toner image of the electrostatic latent image;

a transferor configured to transfer the toner image formed on the photosensitive member onto a recording medium;

a fixer configured to fix the toner image transferred onto the recording medium;

a cooler configured to cool the organic electroluminescence element; and a controller configured to control the cooler to cool the organic electroluminescence element to a predetermined temperature equal to or lower than a crystallizing temperature of an organic substance of the organic electroluminescence element.

10. The image forming apparatus according to claim 9, wherein the cooler comprises a Peltier element.

11. The image forming apparatus according to claim 9, further comprising a temperature sensor configured to detect a temperature of the exposer, wherein the controller is configured to operate the cooler when the temperature of the exposer detected by the temperature sensor exceeds a predetermined temperature.

12. The image forming apparatus according to claim 9, further comprising a temperature sensor configured to detect a temperature of the exposer, wherein the controller is configured to keep the temperature of the exposer within 20 degrees Celsius of an environmental temperature in a steady state.

13. The image forming apparatus according to claim 9, wherein the controller is configured to operate the cooler after a predetermined time period has elapsed from when a power source of the image forming apparatus is turned on.

14. An image forming apparatus, comprising:

a photosensitive member;

a charger configured to charge the photosensitive member;

an exposer configured to irradiate the photosensitive member with light to form an electrostatic latent image, the exposer comprising an organic electroluminescence element;

a developer configured to adhere toner to the photosensitive member to form a toner image of the electrostatic latent image;

a transferor configured to transfer the toner image formed on the photosensitive member onto a recording medium;

a fixer configured to fix the toner image transferred onto the recording medium;

a temperature maintainer configured to maintain a temperature of the organic electroluminescence equal to or lower than a crystallizing temperature of an organic substance of the organic electroluminescence element.

15. The image forming apparatus according to claim 14, wherein the temperature maintainer comprises a fin configured to radiate heat from the organic electroluminescence element.

16. The image forming apparatus according to claim 14, wherein the temperature maintainer comprises a fan that blows air toward the exposer.

17. The image forming apparatus according to claim 16, further comprising a cabinet, wherein the fan is provided on the cabinet.

18. The image forming apparatus according to claim 14, wherein the temperature maintainer comprises a thermally conductive sheet provided in a vicinity of the organic electroluminescence element.

19. An image forming apparatus, comprising:

a photosensitive member;

a charger configured to charge the photosensitive member;

an exposer configured to irradiate the photosensitive member with light to form an electrostatic latent image, the exposer comprising an organic electroluminescence element;

a developer configured to adhere toner to the photosensitive member to form a toner image of the electrostatic latent image;

a transferor configured to transfer the toner image formed on the photosensitive member onto a recording medium;

a fixer configured to fix the toner image transferred onto the recording medium;

a cooler configured to reduce heat applied by the fixer to the organic electroluminescence element;

a light sensor configured to detect an amount of light irradiated from the organic electroluminescence element; and a controller configured to control the cooler to cool the organic electroluminescence element to a predetermined temperature equal to or lower than a crystallizing temperature of an organic substance of the organic electroluminescence element, wherein the controller operates the cooler when the amount of light detected by the light sensor becomes equal to or less than a predetermined amount.

20. An image forming apparatus, comprising:

a photosensitive member;

a charger configured to charade the photosensitive member;

an exposer configured to irradiate the photosensitive member with light to form an electrostatic latent image, the exposer comprising an organic electroluminescence element;

a developer configured to adhere toner to the photosensitive member to form a toner image of the electrostatic latent image;

a transferor configured to transfer the toner image formed on the photosensitive member onto a recording medium;

a fixer configured to fix the toner image transferred onto the recording medium;

a cooler configured to reduce heat applied by the fixer to the organic electroluminescence element;

a darkness sensor configured to detect a darkness of the toner image formed on the recording medium; and a controller configured to control the cooler to cool the organic electroluminescence element to a predetermined temperature equal to or lower than a crystallizing temperature of an organic substance of the organic electroluminescence element, wherein the controller operates the cooler when the darkness of the toner image detected by the darkness sensor becomes equal to or less than a predetermined amount.

* * * * *